United States Patent [19]

McCall

[11] Patent Number: 4,542,615

[45] **Date of Patent: * Sep. 24, 1985**

[54] DROP CEILING FRAMEWORK

[75] Inventor: Francis L. McCall, Hacienda Heights, Calif.

[73] Assignee: Specified Ceiling Systems, Alhambra, Calif.

[ * ] Notice: The portion of the term of this patent subsequent to Mar. 6, 2001 has been disclaimed.

[21] Appl. No.: 540,516

[22] Filed: Oct. 11, 1983

Related U.S. Application Data

[63] Continuation-in-part of Ser. No. 363,603, Mar. 30, 1982, Pat. No. 4,434,599.

[51] Int. Cl.[4] ..... E04B 5/52; E04C 3/30

[52] U.S. Cl. ..... 52/729; 52/484; 52/668

[58] Field of Search ..... 52/729, 664, 668, 730, 52/484

[56] References Cited

U.S. PATENT DOCUMENTS

| | | | |
|---|---|---|---|
| 3,159,252 | 12/1964 | Cotts | 52/729 X |
| 3,832,816 | 9/1974 | Jahn | 52/664 |
| 4,034,531 | 7/1977 | Balinski | 52/484 |
| 4,206,578 | 6/1980 | Mieyal | 52/730 |
| 4,434,599 | 3/1984 | McCall | 52/729 |

*Primary Examiner*—J. Karl Bell

*Attorney, Agent, or Firm*—Christie, Parker & Hale

[57] ABSTRACT

A drop ceiling framework constructed of rolled sheet metal in which a longitudinal T-frame member has a web section formed of two sheet metal layers joined along a longitudinal edge, a channel section formed along the lower edge of the web section, and a pair of flange sections projecting outwardly in a common plane from the open end of the channel section. The flange sections are formed of two layers of sheet metal joined along the outer edge of the flange section. The outer layer of each flange section is notched, exposing the under layer at each position of intersection with cross members of the drop ceiling. The notches are aligned with the channel sections of the cross members to form an extension of the reveal formed by the channel portions of the cross members.

8 Claims, 4 Drawing Figures

DROP CEILING FRAMEWORK

RELATED APPLICATION

This application is a continuation-in-part of application Ser. No. 363,603 filed Mar. 30, 1982 now U.S. Pat. No. 4,434,599.

FIELD OF THE INVENTION

This invention relates to drop ceiling construction and, more specifically, to a roll formed runner for a drop ceiling frame.

BACKGROUND OF THE INVENTION

Drop ceiling construction has become popular in office building design for a number of reasons. The drop ceiling provides an architecturally pleasing appearance and provides a space between the drop ceiling and the structural ceiling for heating and air conditioning ducts, plumbing, wiring and the like. The drop ceiling is constructed from a metal frame in the form of a matrix of runners which are generally of extruded or roll formed metal. The frame is used to support acoustic tile panels and light fixtures. An example of a drop ceiling framework of rolled sheet metal construction is described in U.S. Pat. No. 4,135,441.

SUMMARY OF THE INVENTION

The present invention is directed to an improved drop ceiling frame construction which can be roll formed of sheet metal. The frame has a pleasing appearance architecturally and at the same time provides a strong frame for supporting the ceiling and for securing partitions. A unique slot arrangement forms a reveal and also provides a means of attaching partitions to the underside of the frame at any point along the length of a runner forming the frame. The reveal is continued unbroken at intersections between longitudinal runners and abutting cross members.

This is accomplished, in brief, by providing a T-frame member for a drop ceiling made of rolled sheet metal formed into a web section which is joined to a pair of coplanar flange members by a connecting channel-shaped section, the flange sections being joined to and extending outwardly from the respective outer edges of the two side walls of the channel section. The inner edges of the flanges form lips projecting toward each other between the side walls of the channel section, each lip terminating in an edge extending inwardly toward the bottom wall of the channel.

The flange members are formed by folding the sheet metal along the outer edge of the flange so that each flange section consists of an inner layer attached to the channel section and an outer layer terminating in a lip. At each point of intersection between a longitudinal runner and a cross member, the outer layer of the flange sections of the longitudinal runner are slotted before or while the sheet metal is roll formed, to expose the inner layer. The slots extend in a direction transverse to the longitudinal axis of the runner. The adjacent slots in the two flange sections are aligned with each other and with the channel section of abutting cross members so that the slots form an extension of the reveal formed by the channel sections of the abutting cross members. The flange sections are dimpled or crimped slightly at the slots so that the margins of the slots are rolled in slightly to match more closely the lips forming the margins of the reveal. The offset of the flange where they are dimpled engages the channel sections of the connecting cross members to help secure the cross members in place.

DESCRIPTION OF THE DRAWINGS

For a better understanding of the invention, reference should be made to the accompanying drawings, wherein.

DETAILED DESCRIPTION

Figure 1:
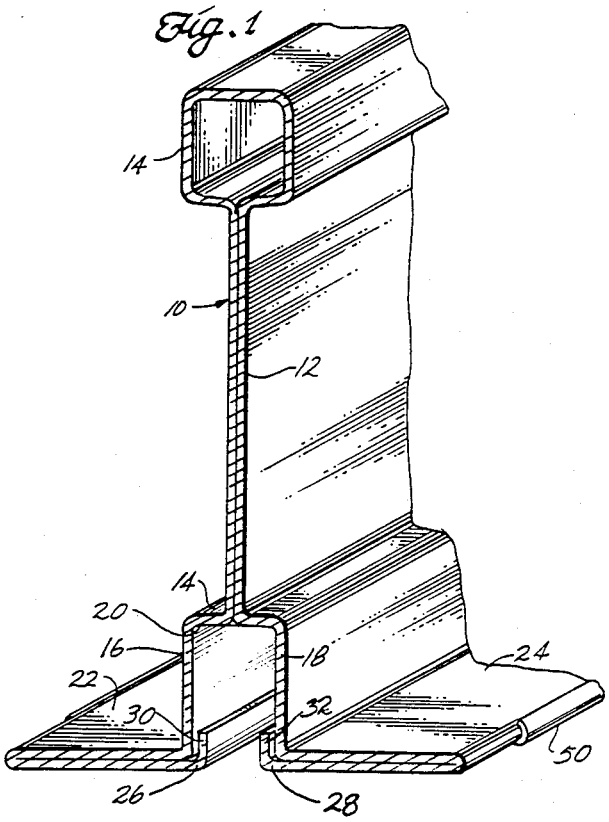
FIG. 1 is an isometric view of a T-frame member.

Referring to FIG. 1 in detail, the numeral 10 indicates generally a T-frame member which may be used as part of a drop ceiling framework. The T-frame member is roll formed from a single longitudinal strip of sheet metal material, such as aluminum or steel. The members can be roll formed into any desired length by conventional roll forming techniques.

The sheet metal is formed to provide a web section 12 consisting of two layers of the sheet metal normally lying in intimate contact. The upper edge of the web section is formed into a box frame section 14 which strengthens the upper edge of the web section against lateral bending. The box section 14 is formed by folding the sheet metal to bring the sheet metal back together to form the two layers of the web section 12.

At the lower edge of the web section 12, the sheet metal layers are bent outwardly and then downwardly to form a channel-shaped section 15, the channel section including a pair of parallel side walls 16 and 18 and a bottom wall 20. The outer edges of the side walls 16 and 18 are formed by folding the sheet metal outwardly to form a pair of coplanar flange sections 22 and 24. The flange sections constitute the cross portion of the T-shaped frame member. The flange sections are formed of two layers of sheet metal by folding the sheet metal over along the outer edges of the flange sections. The outer sheet metal layer of the flange sections projects into the space between the side walls 16 and 18 to form lips 26 and 28, each lip terminating in an edge, indicated at 30 and 32, respectively, extending inwardly toward the bottom wall of the channel. Thus the lips narrow the longitudinal opening into the channel but leave a gap. This opening forms a reveal which gives the drop ceiling frame work an architecturally pleasing appearance. Preferably the inside surface of the sheet metal is coated with a black finish before the sheet metal rolling operation so that the interior of the channel section is not light reflective. This enhances the effect of the reveal.

Figure 2:
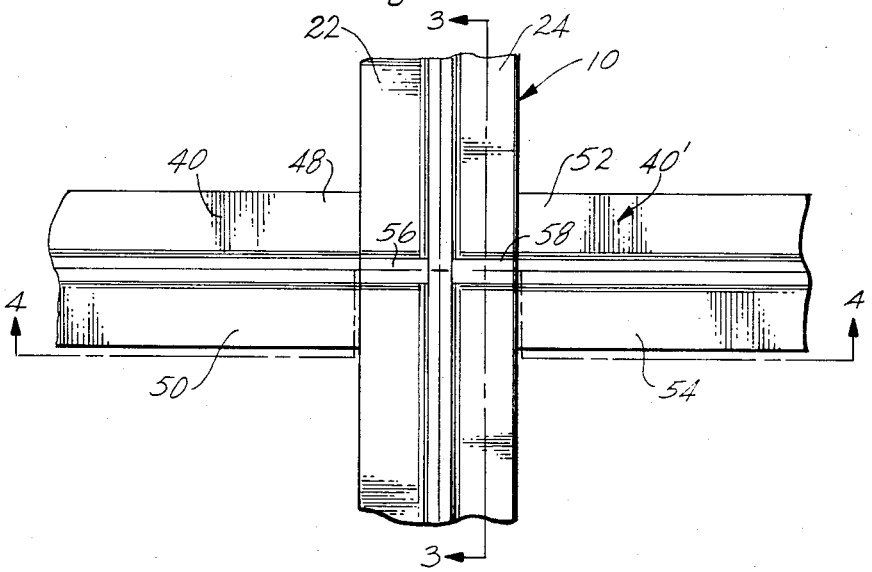
FIG. 2 is a bottom view showing the detail at an intersection between a longitudinal member and a pair of cross members.
Figure 3:
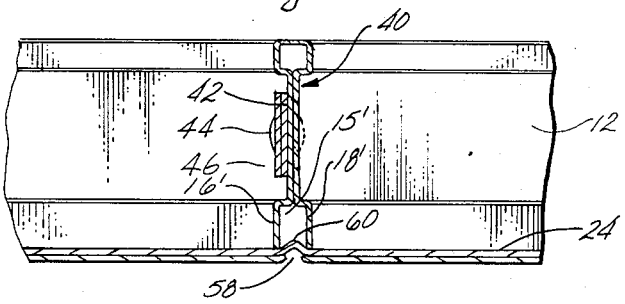
FIG. 3 is a sectional view taken substantially on the line 3—3 of FIG. 2.
Figure 4:
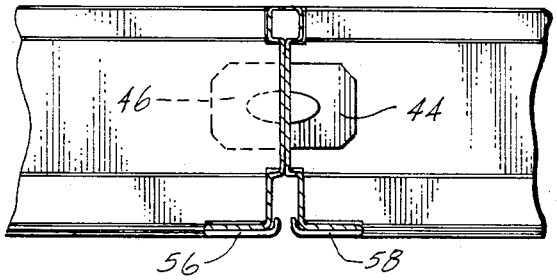
FIG. 4 is a sectional view taken substantially on the line 4—4 of FIG. 2.

Referring to FIGS. 2–4, there are shown the details of the intersection in a grid ceiling structure using the T-frame member shown in FIG. 1. The intersection is formed by two cross members 40 and 40' which are in axial alignment with each other and extend perpendicular to the runner 10. As best seen in FIG. 4, the ends of the abutting cross members 40 and 40' are shaped to fit the cross-sectional contour of the runner 10. At the web portion 12 of the runner 10, a vertical slot 42 receives extensions or tongues 44 and 46 which project from the ends of the respective cross members 40 and 40'. The tongues 44 and 46 hold the cross members in alignment and at the same time lock the cross members to the runner 10.

As best seen in FIG. 2, the flange sections, indicated at 48 and 50, for the cross member 40, and at 52 and at 54 for the cross member 40', are held in abutting relationship with the edge of the flange sections 22 and 24 of the runner 10. The open slots formed by the channel section of the cross members 40 and 40' therefore terminate at the outer edges of the flange sections 22 and 24 of the runner 10. Thus the runner 10 interrupts the reveal formed by the slots in the cross members. According to the present invention, continuation of the reveal is provided by slots formed in the outer layer of the flange sections 22 and 24 of the runner 10, as indicated at 56 and 58. These slots are formed only in the outer layer of sheet metal forming the flange sections 22 and 24, as best shown in FIG. 3. The slots can be preformed in the sheet metal strip before it is roll formed into the desired structural shape. As shown in FIG. 4, the slots extend from the folded outer margin of the flange sections to the inner edges of the lips 30 and 32. The remaining inner layers of the flange sections are then dimpled or crimped along the length of the slots, as indicated at 60 FIG. 3, to provide additional depth to the slots and to provide rounded edges to the margins of the slots. The crimped flanges form projections which engage the channel sections 15' of the abutting cross members. Thus, as seen in FIG. 3, the crimped portion 60 of the flange section projects into the space between the parallel walls 16' and 18' of the intersecting cross member 40'. This helps anchor the cross members against twisting or lateral displacement relative to the connecting runner.

By forming the slots 56 and 58 in this manner, the structural integrity of the runner 10 is maintained. At the same time, by removing the outer layer of the sheet metal in the slots, the surface of the inner layer of the flange sections is exposed. This inner layer has the contrasting color of the interior surface of the sheet metal exposed in the channel section 15. The crimping adds depth to the slots and rounds off the margins of the slots. Thus the slots 56 and 58 give the same appearance as the channel sections forming the reveal extending down the center of the cross members 40 and 40'. While the slots 56 and 58 form notches that obviously are not as deep as the slot formed by the channel section 15, they nevertheless provide the appearance of having depth, and therefore appear to be a continuation of the reveal of the cross members at each intersection of the ceiling grid. Thus this intersection construction provides the effect of continuous intersecting reveals while forming a rigid ceiling grid structure.

What is claimed is:

1. A drop ceiling T-frame member comprising:

a web section formed of two sheet metal layers joined along a longitudinal edge, a channel section having two parallel side walls joined by a transverse wall, the sheet metal layers of the web section being joined along a longitudinal edge to the side walls of the channel section by respective sheet metal sections forming the transverse wall, the side walls of the channel section extending parallel to and away from the web section, a pair of flange sections lying in a common plane extending perpendicular to the plane of the web section, each flange section being formed of two layers of sheet metal joined along the outer edge of the flange section, one layer of each flange section being joined along one longitudinal edge to the outer edge of a respective one of the side walls of the channel section, the flange sections projecting outwardly away from the respective side walls and forming a flat supporting surface on either side of the channel section for supporting ceiling tiles, the said other layer of each flange section having at least one pair of slots extending the width of the flange section, each slot exposing said one layer through the slot in said other layer of the flange section, said pair of slots in the respective flange sections being positioned directly opposite each other on either side of the gap so as to be aligned.

2. Apparatus of claim 1 wherein the edges of each slot extend transversely to the longitudinal axis of the T-frame member, the edges of each pair of aligned slots being parallel and spaced apart a distance substantially equal to the width of said gap.

3. Apparatus of claim 2 wherein the T-frame member is formed from a single sheet metal strip.

4. Apparatus of claim 3 wherein the opposite surfaces of said strip are coated in contrasting shades, whereby the surface of said one layer of each flange section exposed by said slots in said other layer of each flange and the inner surfaces of the channel section are of one shade, in contrast to the shade of all other exposed surfaces of the T-frame.

5. Apparatus of claim 1 further comprising a pair of sheet metal cross T-frame members having the same shape as the longitudinal T-frame member, means securing the cross members to the longitudinal member with one end of each the cross member abutting the longitudinal member, the flange sections of the cross members and longitudinal member lying in a common plane, the gaps between the flange sections of the respective cross members being aligned with each other and with a pair of slots in the flange sections of the longitudinal member.

6. Apparatus of claim 1 wherein the flange sections are dimpled to form a groove at each of the slots with the margins of the slots being rounded into the groove.

7. Apparatus of claim 5 wherein the flange sections are dimpled to form a groove at each of the slots with the margins of the slots being rounded.

8. Apparatus of claim 7 wherein the dimpled slots in the flange sections form a projecting ridge opposite the slots in said one layer, the ridge projecting into the space between the side walls of the channel section of the abutting cross members.

* * * * *